United States Patent [19]

Panek et al.

[11] 4,453,793

[45] Jun. 12, 1984

[54] LOCKING MECHANISM FOR RECTANGULAR ELECTRICAL CONNECTOR

[75] Inventors: George J. Panek; Gerald R. Nieman, both of Phoenix, Ariz.

[73] Assignee: International Telephone and Telegraph Corporation, New York, N.Y.

[21] Appl. No.: 365,300

[22] Filed: Apr. 5, 1982

[51] Int. Cl.[3] ..... H01R 13/62

[52] U.S. Cl. ..... 339/75 M; 339/75 R; 339/91 R

[58] Field of Search ..... 339/75 R, 75 M, 91 R, 339/91 M, 89 M, 136 R, 136 M, 137, 138, 140 R, 140 C, 139 R, 139 C

[56] References Cited

U.S. PATENT DOCUMENTS

| | | | |
|---|---|---|---|
| 3,281,757 | 10/1966 | Bonhomme | 339/91 R |
| 3,352,576 | 11/1967 | Thorne-Thomsen | 285/169 |
| 3,408,614 | 10/1968 | Kuwahata | 339/91 R |
| 3,453,586 | 7/1969 | Brendlen, Jr. | 339/75 M |
| 3,498,647 | 3/1970 | Schroder | 285/343 |
| 3,635,184 | 1/1972 | Liautaud | 339/75 M X |
| 3,779,233 | 12/1973 | Saslow et al. | 128/6 |
| 3,810,073 | 5/1974 | Zajac et al. | 339/91 R |
| 4,007,953 | 2/1977 | Powell | 285/321 |
| 4,037,903 | 7/1977 | Saner | 339/75 R |
| 4,072,386 | 2/1978 | Wallo | 339/91 R |
| 4,130,330 | 12/1978 | Chandler | 339/75 M |
| 4,166,664 | 9/1979 | Herrmann, Jr. | 339/91 R |
| 4,290,662 | 9/1981 | Storcel | 339/89 M |

FOREIGN PATENT DOCUMENTS

| | | | |
|---|---|---|---|
| 1235834 | 5/1960 | France | 339/75 M |

*Primary Examiner*—William R. Briggs

*Attorney, Agent, or Firm*—T. E. Kristofferson; T. L. Peterson

[57] ABSTRACT

A releasable locking mechanism is provided for a rectangular connector in which matching grooves are formed in the outer and inner surfaces respectively of the elongated sides of the shells of the plug and receptacle halves of the connector. Elongated wires are positioned in each of the plug shell grooves. Actuating devices are located at opposite ends of the plug shell which act against inwardly extending legs on the ends of the wires for shifting the wires outwardly to become partially lodged in the grooves in the receptacle shell thereby positively locking the connector members together. The actuating devices may be retracted to allow unmating of the connector halves.

17 Claims, 6 Drawing Figures

LOCKING MECHANISM FOR RECTANGULAR ELECTRICAL CONNECTOR

BACKGROUND OF THE INVENTION

The present invention relates generally to an electrical connector and, more particularly, to a locking mechanism for a rectangular electrical connector.

There are basically two types of electrical connectors, namely, circular and rectangular. The plug and receptacle members of the circular connector are normally interlocked by either a threaded coupling nut or a bayonet coupling nut. Rectangular connectors utilize mounting surfaces or screws through flanges on the plug and receptacle shells to hold the connectors in their mated condition.

Some connectors embody self-locking mechanisms contained in or attached to the connector shells to provide an interlock between the connector halves and to maintain the connector in the mated condition. The self-locking mechanisms previously embodied in rectangular connectors have been complicated and bulky in nature which results in an increase in cost, an increase in weight, and a reduction in reliability of the connectors. Additionally, the bulkiness of these mechanisms places a limitation on the utilization of the connectors in those applications where connector size is important.

U.S. Pat. No. 3,843,853 to Panek et al. discloses a self-locking mechanism for a circular connector which has been referred to as a "ring lock." In this connector, matching grooves are formed in the outer surface of the plug shell and the inner surface of the receptacle shell. The grooves are aligned when the shells are fully mated. The groove in the plug shell is deeper than the groove in the receptacle shell. A split ring is mounted in the grooves. In its normal unstressed condition the ring is lodged in both the grooves thereby interlocking the shells of the mating plug and receptacle halves of the connector. The locking ring is retained in its locking position by a radially extending pin disposed between the free ends of the split ring. When the pin is removed the split ring is free to be contacted upon application of an axially directed unmating force to the mating connector members. A similar ring lock arrangement for a pipe joint is disclosed in U.S. Pat. No. 3,521,911.

Heretofore, no one has applied the ring lock principle to a rectangular connector. That is the object of the present invention. By doing so, a self-locking rectangular connector may be provided which is neither complicated nor bulky as the other self-locking rectangular connectors mentioned hereinbefore. The decrease in comparative complexity decreases the cost and increases the reliability of the connector. The decrease in bulkiness allows the connector to be utilized in applications where space is an important factor.

SUMMARY OF THE INVENTION

According to a principal aspect of the present invention, there is provided an electrical connector having mating plug and receptacle members each embodying rectangular shells one telescopically mounted within the other. The shells have elongated sides and opposed relatively shorter ends. Matching grooves are formed in the inner and outer surfaces of the elongated sides of the shells, running lengthwise of such sides. An elongated wire is positioned in each of the grooves in the plug shell. Actuating means is provided for shifting each of the wires outwardly to become partially lodged into the receptacle shell grooves to thereby lock the plug and receptacle members together. By releasing the actuating means, the plug and receptacle members may be disengaged in a manner similar to the ring lock circular connector described hereinbefore.

Thus, the present invention provides a quick releasable, but positive locking mechanism for a rectangular connector which provides the locking action along the long sides of the connector which is particularly advantageous due to the fact that the loading on the connector shells are due to the electrical components being distributed along the length of the shells.

DESCRIPTION OF THE PREFERRED EMBODIMENT

Figure 1:
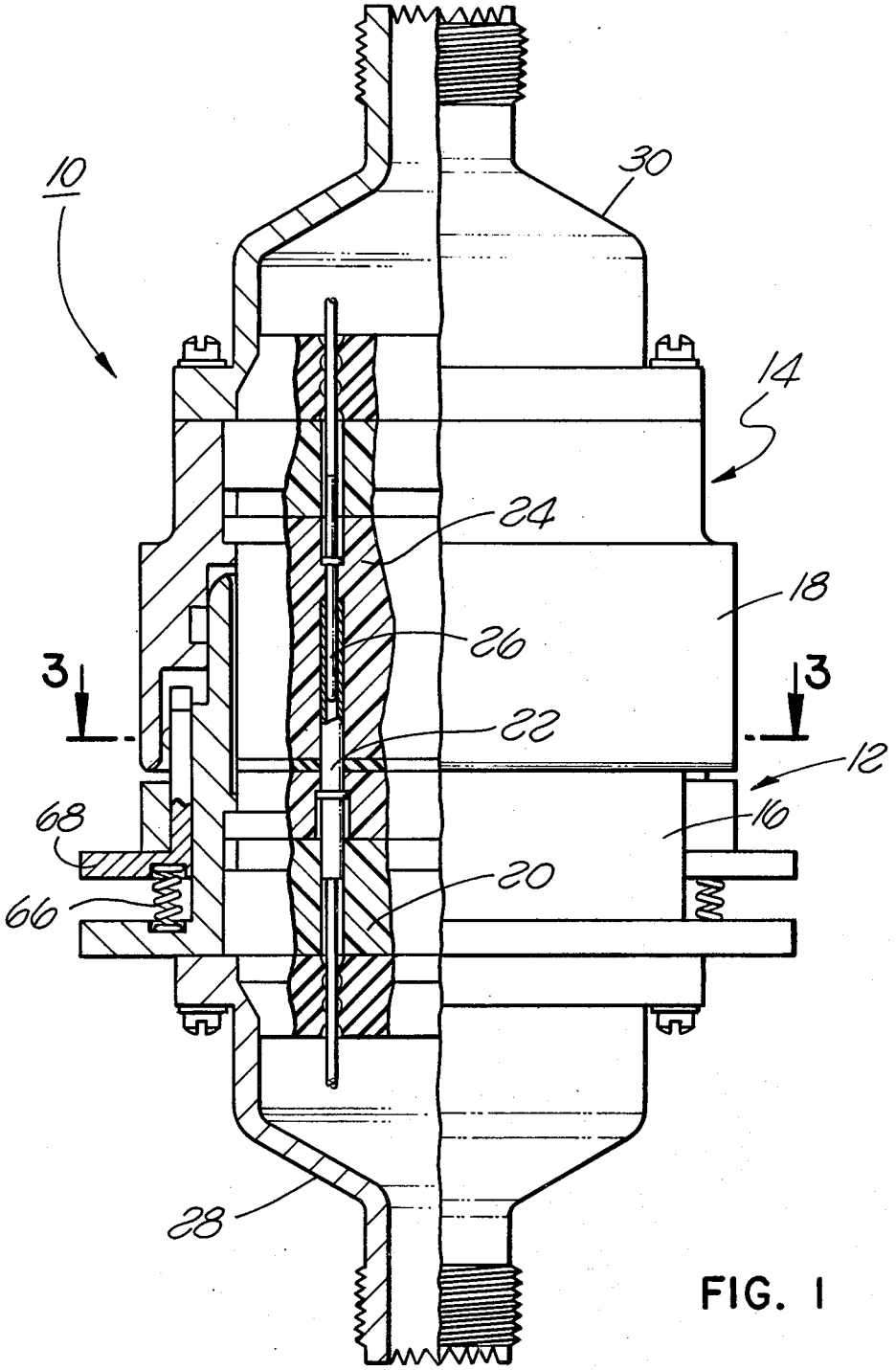
FIG. 1 is a partial longitudinal sectional view through the connector of the present invention with the actuating devices for the locking mechanism shown in their forward locking position.

Referring now to the drawings in detail, the connector of the present invention, generally designated 10, comprises a plug connector member 12 and a receptacle connector member 14. The plug connector member 12 has a shell 16 of rectangular configuration which is telescopically mounted within the receptacle shell 18 of complementary rectangular configuration. The plug shell 16 contains an insulator assembly 20 in which there are mounted a plurality of electrical contacts 22. The receptacle shell 18 also contains an insulator assembly 24 containing contacts 26 which mate with the contacts 22 when the plug and receptacle members are interengaged. The construction of the connector insulators and contacts may be conventional, and constitutes no part of the present invention. If desired, endbells 28 and 30 may be mounted on the rear of the plug and receptacle shells, respectively.

The locking mechanism for the plug and receptacle members includes a pair of elongated locking wires, each designated 32. The locking wires are located in elongated grooves 34 formed in the outer surface of the relatively long sides 36 of the plug shell 16. The grooves 34 intersect grooves 38 formed in the relatively short ends 40 of the plug shell. Each locking wire has a leg 42 formed at its opposite ends and extending generally perpendicular of the length of the wire. The legs 42 lie in the grooves 38. Inwardly extending tabs 44 are formed on the legs 42. The wires are retained on the plug shell by the tabs 44 fitting into notches 46 at the ends 40 of the plug shell.

Figure 5:
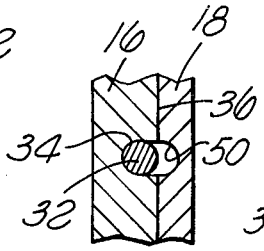
FIG. 5 is a sectional view taken along line 5—5 of FIG. 3.

As best seen in FIG. 5, the depth of each groove 34 is sufficient to allow the locking wire 32 to be disposed entirely within the groove, i.e., beneath the outer surface of the elongated side 36 of the plug shell 16. When the locking wires are so disposed, they are in their release, unlocking position.

Figure 6:
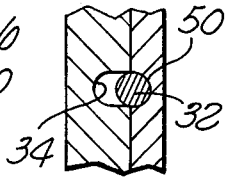
FIG. 6 is a sectional view taken along line 6—6 of FIG. 4.
Figure 3:
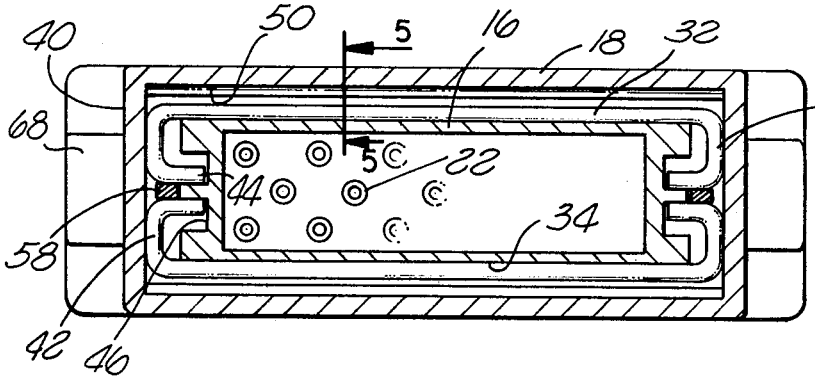
FIG. 3 is a transverse sectional view taken along line 3—3 of FIG. 1 showing the locking wires in their release, unlocking position.
Figure 4:
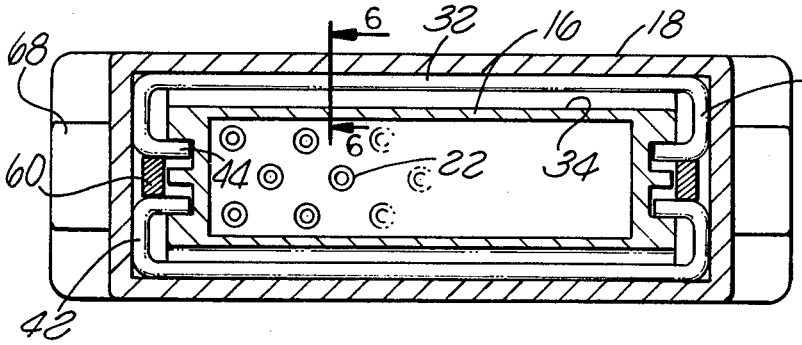
FIG. 4 is a sectional view similar to FIG. 3 showing the locking wires in their outer locking position.

As seen in FIGS. 3 to 6, elongated grooves 50 are formed in the inner surface of the receptacle shell 18 matching the grooves 34 in the plug shell. The grooves 50 are shallower than the grooves 34 so that when the locking wires 32 are urged outwardly they will become only partially lodged into the grooves 50, as seen in FIGS. 4 and 6, thereby providing a positive interlock between the connector shells 16 and 18. Thus, in principal the wire lock arrangement of the present invention functions similarly to the ring lock disclosed in the aforementioned Panek et al. patent. However, in contrast to the ring lock mechanism in which the split ring is normally disposed in an expanded locking position, in the present invention it is necessary to provide an actuating device for spreading the locking wires 32 outwardly into the grooves 50 in the receptacle shell. Such actuating device, generally designated 52, is provided at each end 40 of the plug shell. Each actuating device comprises a plunger 54 axially slidable in a housing 56 on the end 40 of the plug shell. The plunger has a stepped configuration providing a forward narrow portion 58, a rear wider portion 60 and a tapered transition region 62 providing a pair of inclined cam surfaces 64 on its opposite sides.

Figure 2:
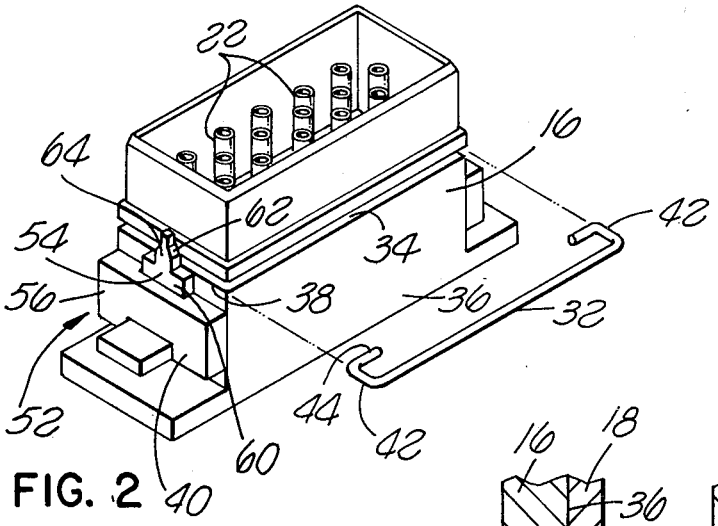
FIG. 2 is a perspective view of the plug connector member of the connector illustrated in FIG. 1 showing one of the locking wires removed from the plug shell.

In FIGS. 2 and 3, the plunger 54 is shown in a retracted, release position wherein the forward narrow portion 58 of the plunger is disposed between the legs 42 on the ends of the locking wires, thus allowing the wires to be entirely disposed within the grooves 34 in the plug shell. In this position of the locking wires, the plug and receptacle connector members are free to be slidably interengaged (the plug shell 16 will slide into the receptacle shell.) The plungers 54 may be shifted to the retracted position against the force of coil springs 66 by outwardly extending fingers 68 on the plungers. When the connector shells are interengaged, the operator will release the fingers 68 whereupon the springs 66 will urge the plungers forwardly so that the cam surfaces 64 thereon will cooperate with the ends of the legs 42 urging the locking wire outwardly into the grooves 50 in the receptacle shell, as illustrated in FIGS. 4 and 6, thereby positively locking the connector members together. The locking wires are retained in such locking position by the wider portions 60 of the plungers 54 being disposed between the ends of the legs of the wires as seen in FIG. 4.

It is particularly advantageous that the locking wires 32 extend along the long sides of the plug and receptacle shells because the loading on the shells due to the electrical contacts therein is distributed along this length. This provides a considerable improvement over those locking mechanisms utilized in prior rectangular connectors which are typically disposed at the ends of the connector shells.

To unmate the connector, the plungers 54 are retracted by pressing rearwardly on the fingers 68 so that only the narrow forward portions 58 of the plungers are disposed between the legs 42 on the locking wires, thus allowing the locking wires to collapse into the grooves 32 in the plug shell. The wires collapse into such grooves upon application of an axially directed force withdrawing the plug shell from the receptacle shell whereupon the curved surface of each groove 50 in the receptacle shell functions as a camming surface acting upon the curved surface of the corresponding locking wire urging it inwardly into the groove 34. If desired, the plungers 54 of the actuating devices of the connector may be operated either semi-automatically, or fully automatically, which may be desirable if the connector must be unmated from a remote position.

From the foregoing, it will be appreciated that the wire locking mechanism of the present invention not only provides a very effective locking arrangement along the entire length of a rectangular connector, but also is relatively simple, inexpensive, and does not add significantly to the size of the connector.

What is claimed is:

1. An electrical connector comprising:

mating plug and receptacle members;

said plug member having an inner shell of generally rectangular configuration telescopically mounted within an outer shell of the receptacle member of complementary rectangular configuration;

each of said shells having a pair of elongated sides and opposed, relative shorter ends;

a groove formed in the outer surface of each side of said inner shell extending lengthwise of said side;

a matching groove formed in the inner surface of each side of said outer shell, said grooves in said inner shell being aligned with said grooves in said outer shell when said plug and receptacle members are fully mated;

an elongated wire positioned in each of said inner shell grooves; and actuating means for shifting each of said wires outwardly to become partially lodged into the outer shell grooves to thereby lock said plug and receptacle members together.

2. An electrical connector as set forth in claim 1 wherein:

said actuating means is located at least at one of said ends of said shells.

3. An electrical connector as set forth in claim 2 wherein:

each of said wires has a pair of legs at its opposite ends extending over the ends of said inner shell; and said actuating means comprises actuating devices positioned between the ends of the legs of said wires at each end of said shells.

4. An electrical connector as set forth in claim 3 wherein:

each said actuating device comprises a plunger axially movable on said plug shell between a forward locking position and a rear release position.

5. An electrical connector as set forth in claim 4 including:

means biasing said plungers toward said locking position.

6. An electrical connector as set forth in claim 4 including:

means for selectively retracting said plungers to said release position.

7. An electrical connector as set forth in claim 1 including:

cam surface means between said wires and said grooves in said inner surfaces of said outer shell for forcing said wires out of said grooves into the grooves in said inner shell in a release position upon application of an axially directed force to one of said members relative to the other of said members.

8. An electrical connector as set forth in claim 7 wherein:

said grooves in said inner shell have a depth at least as great as the cross-section of said wires.

9. An electrical connector as set forth in claim 5 wherein:

each said plunger embodies cam means for forcing said legs away from each other when said plunger is shifted from said rear position to said forward locking position by said biasing means.

10. An electrical connector as set forth in claim 4 wherein:

each said plunger has a forward narrow portion, a wider portion spaced behind said narrow portion, and a tapered transition region between said narrow and wider portions;

when said plungers are located in their rear release position said narrow portions of said plungers are positioned between the ends of said legs, said wires being releasable from said grooves in said outer shell with said plungers in said rear position; and said legs are urged apart to shift the wires into said outer shell grooves when said plungers are shifted forwardly toward their locking positions, said wider portions of said plungers being seated between said legs to retain said wires in said outer shell grooves when said plungers are in said forward locking position.

11. An electrical connector as set forth in claim 10 including:

spring means biasing said plungers toward said locking position; and means for selectively retracting said plungers to said release position.

12. An electrical connector as set forth in claim 1 including:

means for retaining said wires in said inner shell grooves when said plug and receptacle members are disengaged.

13. A plug connector member adapted to mate with a receptacle connector member comprising:

a plug shell of generally rectangular configuration adapted to be telescopically mounted within a rectangular shell of a receptacle connector member;

said plug shell having a pair of elongated sides and opposed, relative shorter ends;

a groove formed in the outer surface of each side of said plug shell extending lengthwise of said side;

an elongated wire positioned in each of said grooves;

means retaining said wires on said plug shell; and actuating means for shifting each of said wires outwardly to a locking position for interlocking said plug shell to the receptacle shell.

14. An electrical connector comprising:

a pair of mating electrical connector members having telescoping inner and outer shells of generally rectangular configuration providing relatively long sides and short ends;

each said shell having an open front and open rear;

each said shell surrounding an insulator containing electrical contacts, each said insulator being exposed at the front and rear of its respective shell;

releasable locking means for said shells extending along said long sides thereof for interlocking said shells when said connector members are mated; and means located at least at one of said short ends for actuating and releasing said locking means.

15. An electrical connector as set forth in claim 14 wherein:

said locking means comprises elongated wires extending lengthwise of said sides.

16. An electrical connector as set forth in claim 14 including:

cam means on the inside of said outer shell cooperating with said locking means to release said locking means when said shells are pulled apart to disengage said connector members.

17. An electrical connector as set forth in claim 14 wherein:

said actuating and releasing means are located at both of said short ends.

* * * * *